US010633718B1

(12) United States Patent
Dudt et al.

(10) Patent No.: US 10,633,718 B1
(45) Date of Patent: Apr. 28, 2020

(54) APPARATUS AND METHOD FOR INNER CYLINDRICAL SURFACE ENHANCEMENT AND COMPACTION OF A STRUCTURE USING GLASS FAILURE GENERATED PULSE

(71) Applicants: Philip Dudt, North Bethesda, MD (US); Roshdy George Barsoum, McLean, VA (US)

(72) Inventors: Philip Dudt, North Bethesda, MD (US); Roshdy George Barsoum, McLean, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 164 days.

(21) Appl. No.: 15/720,111

(22) Filed: Sep. 29, 2017

(51) Int. Cl.
*C21D 7/06* (2006.01)
*B21D 26/00* (2006.01)

(52) U.S. Cl.
CPC ..... *C21D 7/06* (2013.01); *B21D 26/00* (2013.01)

(58) Field of Classification Search
CPC ..... B21D 26/06; B21D 26/08; C21D 1/06; C21D 1/09; C21D 10/00
USPC ..... 72/53, 56, 61, 62
See application file for complete search history.

(56) References Cited

U.S. PATENT DOCUMENTS 2,629,325 A * 2/1953 Sweetman ..... F42B 3/08 102/310
3,252,312 A * 5/1966 Maier ..... B21D 26/08 72/56
3,661,004 A * 5/1972 Lee ..... B21D 26/08 72/56
3,751,954 A * 8/1973 Ezra ..... B21C 37/06 72/56
2011/0309074 A1* 12/2011 Thunhorst ..... F17C 1/16 220/23.9
2012/0273095 A1* 11/2012 Masek ..... C21D 8/10 148/654

OTHER PUBLICATIONS

Janiszewki, Jacek et al. Development of Electromagnetic Ring Expansion Apparatus for High-Strain-Rate Test, 2009, Solid State Phenomena, vols. 147-149, pp. 645-650.*

* cited by examiner

*Primary Examiner* — Adam J Eiseman
*Assistant Examiner* — Stephen Floyd London
(74) *Attorney, Agent, or Firm* — Dave Ghatt

(57) ABSTRACT

An apparatus and method for hardening and compacting an inner face of a cylindrical opening of a structure. The apparatus and method is directed towards the hardening and compaction of an elongated cylindrical opening by surrounding the inner face of the cylindrical opening with a glass tube, and initiating an explosive volume expansion of the glass. This in turn, creates a compressive force that acts on the inner face to compact and harden the surface.

5 Claims, 5 Drawing Sheets

APPARATUS AND METHOD FOR INNER CYLINDRICAL SURFACE ENHANCEMENT AND COMPACTION OF A STRUCTURE USING GLASS FAILURE GENERATED PULSE

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

CROSS-REFERENCE TO RELATED APPLICATIONS

This application is related to the pending U.S. Non Provisional patent application, application Ser. No. 15/719,868 filed concurrently with the instant application, herein incorporated by reference, entitled "Apparatus and Method for Outer Surface Enhancement and Compaction of a Cylindrical Structure Using Glass Failure Generated Pulse," by inventors Philip Dudt and Roshdy George Barsoum.

This application is related to the pending U.S. Non Provisional patent application, application Ser. No. 15/719,951 filed concurrently with the instant application, herein incorporated by reference, entitled "Apparatus and Method for Outer Surface Enhancement and Compaction of a Spherical Structure Using Glass Failure Generated Pulse," by inventors Philip Dudt and Roshdy George Barsoum.

This application is related to the pending U.S. Non Provisional patent application, application Ser. No. 15/720,033 filed concurrently with the instant application, herein incorporated by reference, entitled "Apparatus and Method for Outer Surface Enhancement and Compaction of an Object Using Glass Failure Generated Pulses in an Explosive Arrangement," by inventors Philip Dudt and Roshdy George Barsoum.

TECHNICAL FIELD

The following description relates generally to an apparatus and method for treating articles, using glass failure generated pulses. In particular, the apparatus and method is directed towards the hardening and compacting the inner cylindrical surface of a structure, by utilizing an explosive volume expansion of the glass created with an inner tube that surrounds the inner cylindrical surface is shattered by a high velocity striker.

BACKGROUND

There is always a need for stronger and harder alloys to improve the performance and lifetime of structures and platforms. Engineers are looking for high strength materials to improve performance and safety, while maintaining low weight requirements. Strength limitations directly affect how industrial parts are used. Engineers are actively looking for alloys with material properties sufficient for manufacturing and use, while providing fatigue, fracture, and corrosion resistance, while maintaining or improving mechanical properties.

Fatigue and fracture strengths of machinery parts, nonmoving parts such as gun barrels, and weldments can be improved by generating high compressive strengths on their surface. The benefit is that the compressive stresses must be overcome before tension strains can be produced leading to crack initiation and extension. A number of known methods are used industrially for enhancing the surface strength profile. This includes the application of plastic stresses imparted using large rolling machines, carbonizing, shot peening, and explosive detonation.

Many industrial parts, which cannot be otherwise produced by casting, rolling or forging, can be fabricated using powder metallurgy techniques. The parts, such as gears, shafts, and brackets etc., are compacted and the powder with matrix portions are bonded together using hot isostatic pressing (HIP), along with follow-on heat application. Dynamically compressing parts under high dynamic loading is a useful process.

Another known technique for treating the surfaces of industrial parts to improve fatigue and fracture properties is shot peening. This technique enables a rise in the hardness of a surface layer of a work piece and introduction of compressive residual stress into the surface layer. This technique is widely used in the industrial fields of automobiles, aircrafts, etc.

Yet another known technique is laser shock hardening. This involves irradiating the surface of a solid material, such as a metal or a ceramic, with pulsed laser beam through a liquid to adjust surface of internal characteristics of the material, such as structure, hardness and residual stress.

Generally speaking, laser shock hardening has a higher effect than shot peening and in addition has various excellent advantages that shot peening does not have, such as capability of contactless operation, no involvement of reaction force and capability of precise control of laser irradiation conditions and laser irradiation sites. Even with all these known techniques, it is still desired to have a method and an apparatus to improve the ability to strengthen and to make more compact, the surface of industrial parts. Such a method may also be used to supplement other forms of surface hardening, such as carburizing, nitriding and cyaniding.

SUMMARY

In one aspect, the invention is a system for hardening and compacting an inner face of a cylindrical opening of a structure. In this aspect the structure includes a confinement assembly. The confinement assembly includes the structure that has an inner cylindrical opening and an inner face. According to the invention, a longitudinal axis X extends through the center of the inner cylindrical opening. The confinement assembly also includes a glass tube positioned within and contacting the inner face of the cylindrical opening. The system also includes a striker for striking and shattering the glass tube, and a launching mechanism for launching the striker to create an explosive volume expansion of the glass. This results in compressive forces being applied to the inner face of the inner cylindrical opening, thereby hardening and compacting the inner face of the structure.

In another aspect, the invention is a method of hardening and compacting an inner face of a cylindrical opening of a structure. In this aspect, the method includes, providing a confinement assembly. The confinement assembly includes a structure having an inner cylindrical opening having an inner face, with a longitudinal axis X extending through the center of the inner cylindrical opening. The confinement assembly also includes a glass tube positioned within and contacting the inner face of the cylindrical opening, with the glass tube having a bore, and wherein the longitudinal axis X extends through the center of the glass tube. The method also includes, providing a striker. The method also includes launching the striker to create an explosive volume expansion of the glass, which causes compressive forces being applied to the inner face of the inner cylindrical opening, thereby hardening and compacting the inner face of the structure. According to the method, the launching mechanism is one of, a projectile component, an explosive charge, or an electromagnetic circuit, for launching and directing the striker towards the glass tube, so that upon shattering the glass, one or more of the following occurs: multiple cracks form in the glass tube so that the volume occupied by glass in the glass tube increases as the cracks rupture and expand; failure waves propagate through the glass tube with large amount of kinetic energy stored ahead of the waves. According to the method, the occurrences of one or more of a and b, creates the explosive volume expansion of the glass, which results in said compressive forces being applied to the cylindrical structure.

BRIEF DESCRIPTION OF THE DRAWINGS

Other features will be apparent from the description, the drawings, and the claims.

DETAILED DESCRIPTION

Figure 1A:
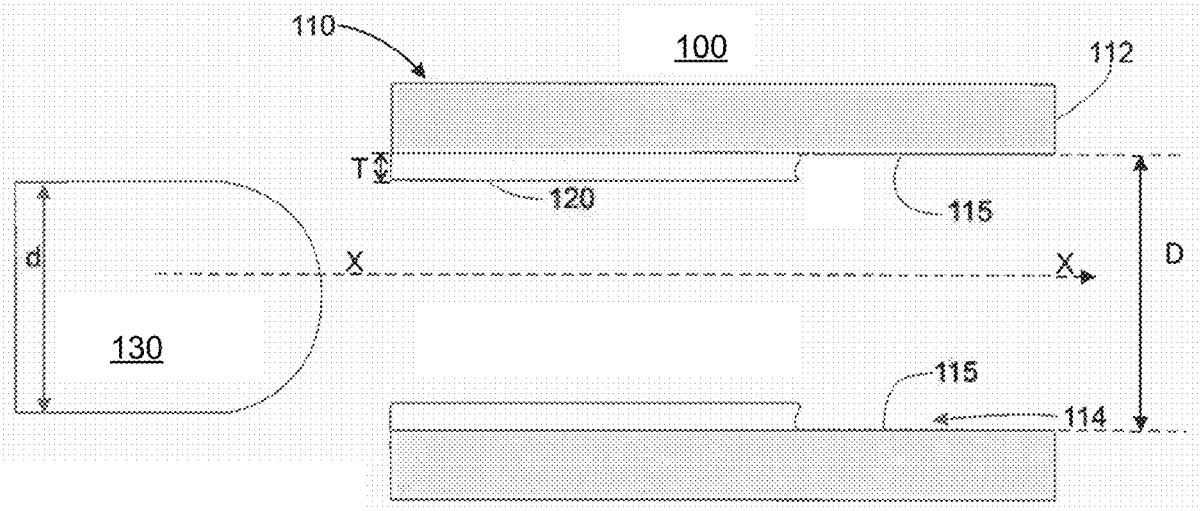
FIG. 1A is an exemplary sectional view of a system for hardening and compacting an inner face of a cylindrical opening of a structure, according to an embodiment of the invention.

FIG. 1A is an exemplary sectional view of a system 100 for hardening and compacting an inner face of a cylindrical opening of a structure, according to an embodiment of the invention. As shown, the system 100 includes a confinement assembly 110 and a striker 130. The confinement assembly 110 includes a structure 112 having an inner cylindrical opening 114 having an inner face 115. As shown, the cylindrical opening 114 and the inner face 115 extend in a direction substantially parallel to a longitudinal axis X. The longitudinal axis X extends through the midpoint of the cylindrical opening 114.

Figure 2A:
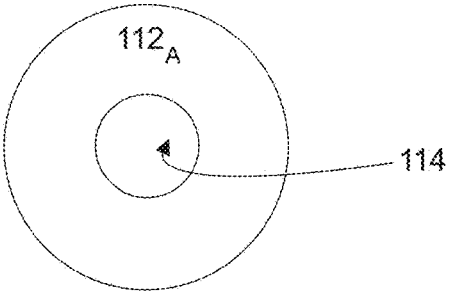
FIG. 2A is an exemplary sectional illustration through AA' of FIG. 1A, according to an embodiment of the invention.
Figure 2B:
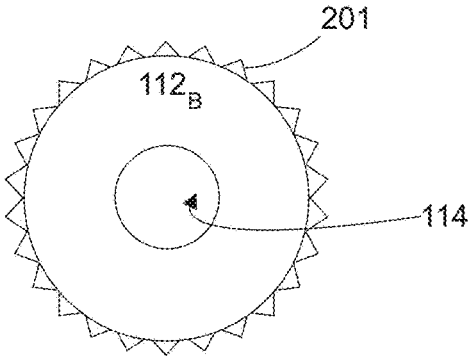
FIGS. 2B-2F are exemplary sectional illustrations of structures, according to embodiments of the invention.
Figure 2C:
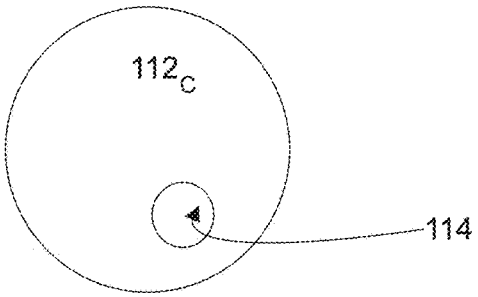
Figure 2D:
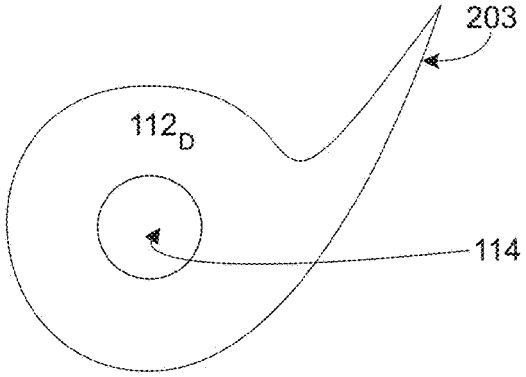
Figure 2E:
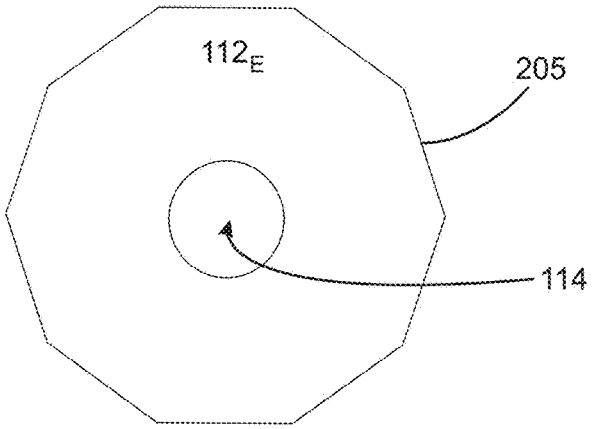
Figure 2F:
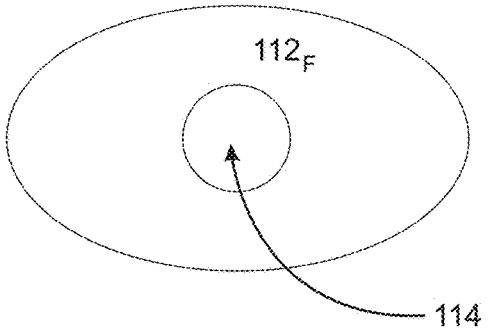

The structure 112 may be a working part of a mechanical device and may have any shape. However, regardless of the overall shape of structure 112, according to the invention, the structure 112 has a cylindrical opening 114 and inner face 115. FIG. 2A is an exemplary sectional illustration through AA' of FIG. 1A, showing the structure being a cylinder 112A. FIGS. 2B-2F show alternative sectional shapes for the structure 112, each illustration $\mathbf{112}_B$-$\mathbf{112}_F$ an inner cylindrical opening 114 having an inner face 115. FIG. 2B illustrates a cylindrical gear $\mathbf{112}_B$, with teeth 201. FIG. 2C illustrates a cylindrical cam $\mathbf{112}_C$, with an off-center cylindrical opening 114. FIG. 2D illustrates a camming device $\mathbf{112}_D$, with cam surface 203. FIG. 2E illustrates a decagon 1128, with flat sides 205. However, FIG. 2E is generally representative of any flat-sided cylindrical arrangement (such as a pentagon or an octagon e.g.) having more or less than 10 sides. FIG. 2F illustrates an elliptical structure $\mathbf{112}_F$. It should be understood that, although not illustrated, other structures not shown, with cylindrical openings are within the scope of this invention.

The structure 112 may be made from metallic materials such as 1015 steel, 4140 steel, and the like. The structure 112 may be used as an industrial part in a mechanical operation, for example, and thus may be sized in accordance with the application. Thus, for example, the structure 112 could be a cylinder piping structure and could be part of the propulsion or drive assembly in a ship. The structure 112 could vary in size, and the cylindrical opening could have a diameter D of about 0.5 inches to about 3.0 inches in diameter.

The confinement assembly 110 also includes a glass tube 120. As shown, the glass tube 120 is positioned within and contacting the inner face 115 of the cylindrical opening 114. The glass tube is positioned concentrically with respect to the cylindrical opening, and thus, the longitudinal axis X also extends through the midpoint of the glass tube 120. Although FIG. 1A does not show the glass tube 120 extending along the entire inner surface 115, the glass tube 120 is meant to extend along the entire length of the area to be hardened. Thus, it is within the scope of this invention to treat only a portion of the cylindrical opening 114. Regarding the illustration of FIG. 1A, a portion of the glass tube 120 is omitted merely to clearly show the cylindrical opening of the structure 112.

According to one embodiment of the invention, the glass tube 120 is a solid glass tube. The glass may be for example, any known type of glass such as silica glass, fused silica, fluoride glass, alumino silicate glass, phosphate glass, borosilicate glass, or flint glass. The glass tube 120 may have a thickness T. According to an embodiment of the invention, the thickness T may be about 0.25 in to about 2.0 in.

Figure 1B:
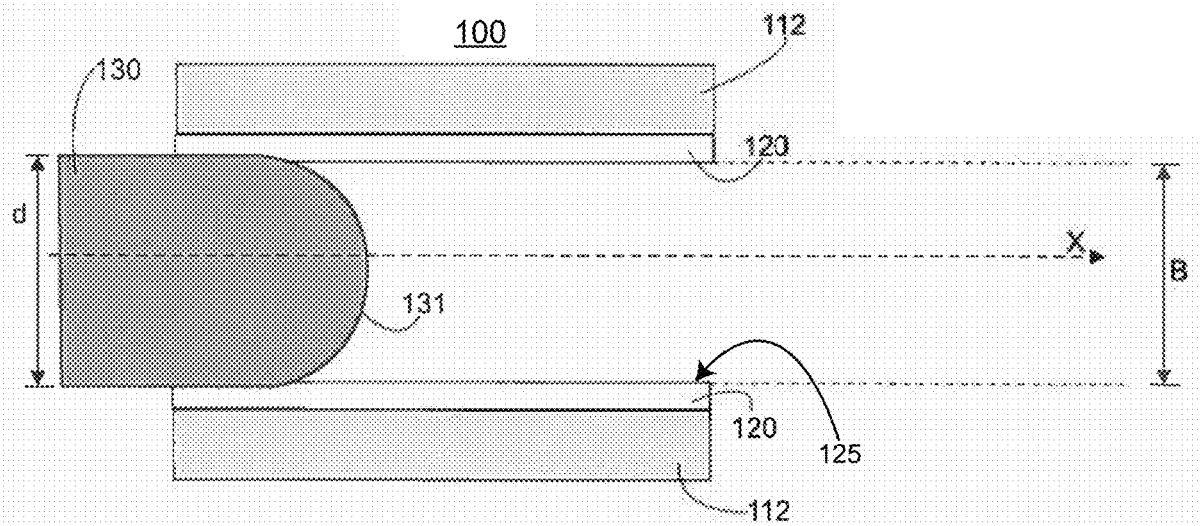
FIG. 1B is an exemplary sectional view of a system for hardening and compacting an inner face of a cylindrical opening of a structure, according to an embodiment of the invention.
Figure 1C:
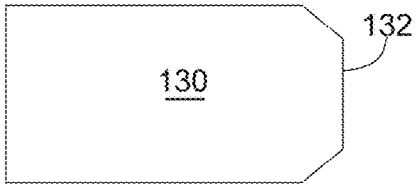
FIGS. 1C and 1D are exemplary illustrations of strikers having alternative tip portions, according to embodiments of the invention.
Figure 1D:
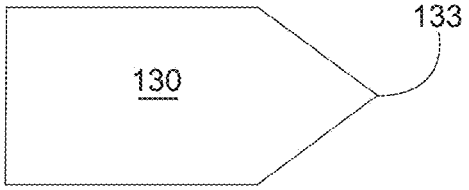

FIG. 1B is an exemplary sectional view of a system 100 for hardening and compacting an inner face of a cylindrical opening of a structure, according to an embodiment of the invention. FIG. 1B shows the striker 130 within the glass tube 120, travelling in a direction parallel to longitudinal axis X. As outlined below, the striker 130 is launched so that the longitudinal axis X extends through the midpoint of the striker 130, thus the striker 130 is in a concentric arrangement with the glass tube 120 and the cylindrical opening 114.

FIG. 1B also shows the striker 130 being an elongated cylindrical projectile having a rounded tip 131. However, the striker 130 may also have a flat tip 132, or a pointed front 133, as shown in Figures IC and ID, respectively. As shown, the striker also has a diameter d. FIG. 1B also shows a bore opening 125 having a diameter B, which is the cylindrical opening of the glass tube 120. As shown, the diameter d of the striker 130 is larger than the diameter B of the bore opening 125. As outlined below, because of this difference in size, when the striker 130 is fired into the bore opening 125, the striker 130 shatters the glass of the glass tube 120 to create an explosive volume expansion of the glass, which in turn creates a compressive force that acts on the inner face 115 to compact and harden the surface.

Figure 3:
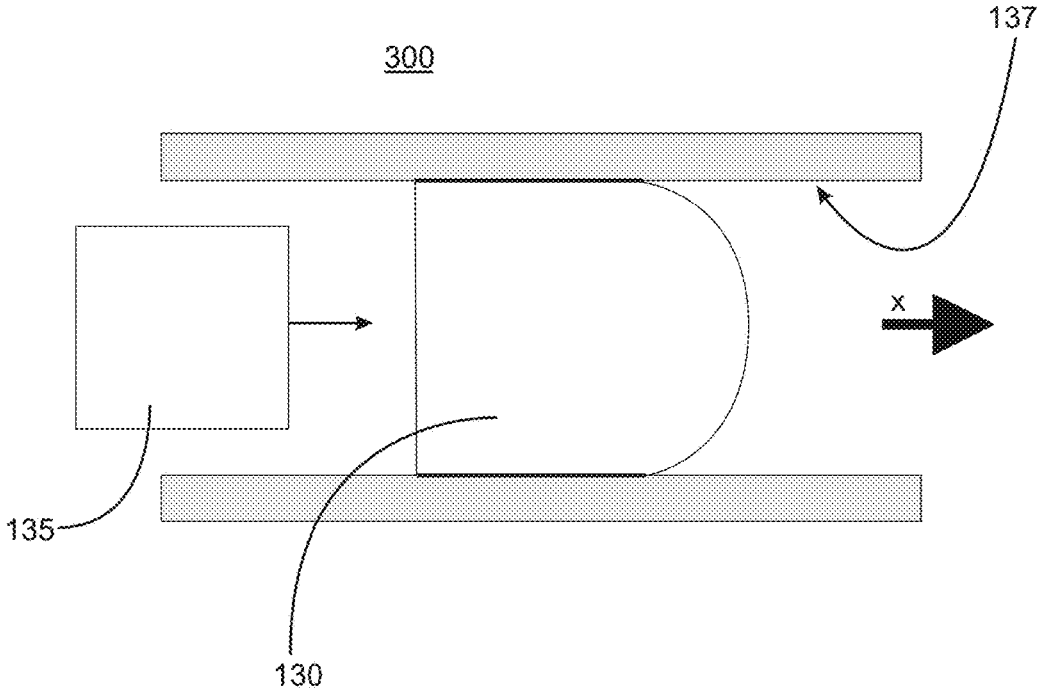
FIG. 3 is a simplified exemplary illustration of a launching mechanism for launching the striker 130, according to an embodiment of the invention.

The striker 130 could be launched by a known mechanism, such as a gas gun, contact explosive, or by a drop weight device. FIG. 3 is a simplified exemplary illustration of a launching mechanism 300 for launching the striker 130, according to an embodiment of the invention. The launching mechanism includes a cylindrical passage 137 that complements the shape of the striker 130, and is aligned to direct the striker assembly 130 towards the bore opening 125 in a direction substantially parallel to longitudinal axis X.

The launching mechanism 300 includes a device, charge, explosive, or the like for launching the striker assembly. This mechanism is shown schematically as element 135, and may be a projectile component that is a part of a known gun, such as a gas gun or a rail gun, which impacts the striker 130. Alternatively, element 135 may represent an explosive charge. Explosive charges of pentotite, C-4, or other known explosives are applicable with charge sizes on the order of about 0.0625 to about 0.5 lbs. are applicable. When set in motion by these known firing components, such by impact from projectile component 135 or by direct gas or rail gun or explosive, the striker 130 may be set in motion at speeds of about 500 feet per second to about 20,000 feet per second.

In operation, the striker 130, moves at a high velocity in direction X, and impinges on the glass tube 120, making contact with the glass because of the difference in the sizes of the striker diameter d and the bore diameter B. The striker 130 is launched so that the longitudinal axis X extends through the central longitudinal axis of the striker 130, thereby defining a concentric arrangement of the striker 130 with respect to both the tube 120 and the cylindrical opening 114, so that the striker 130 contacts the entire cylindrical wall of the glass tube 120, and not merely portions of it. It should be understood that the difference is diameters between d and B may be so small that when launched directly through the center of the bore parallel to direction X, the striker merely grazes inner surfaces of the glass tube 120. The launching mechanism 300 launches the striker 130 at speeds between 500 feet per second to about 20,000 feet per second. As outlined below, this generates explosive forces for several reasons.

First, due to the phenomenon called "Reynolds Dilatancy" in which multiple cracks force the volume occupied to increase as the cracks rupture and expand the molecular structure. The glass experiences this Reynolds Dilatancy when impacted by the high velocity striker 130. The pressure created by the ruptured glass within the confined area between the striker 130 and the inner face 115 of the structure, serves to pressurize the structure 112 at the inner face 115, thereby hardening and compacting the structure 112. Structures 112 that are treated as outlined above could have different sizes with different cylindrical openings. For example, the structure 112 may have a cylindrical opening 114 with a diameter D of about 0.5 inches to about 3.0 inches.

Figure 4:
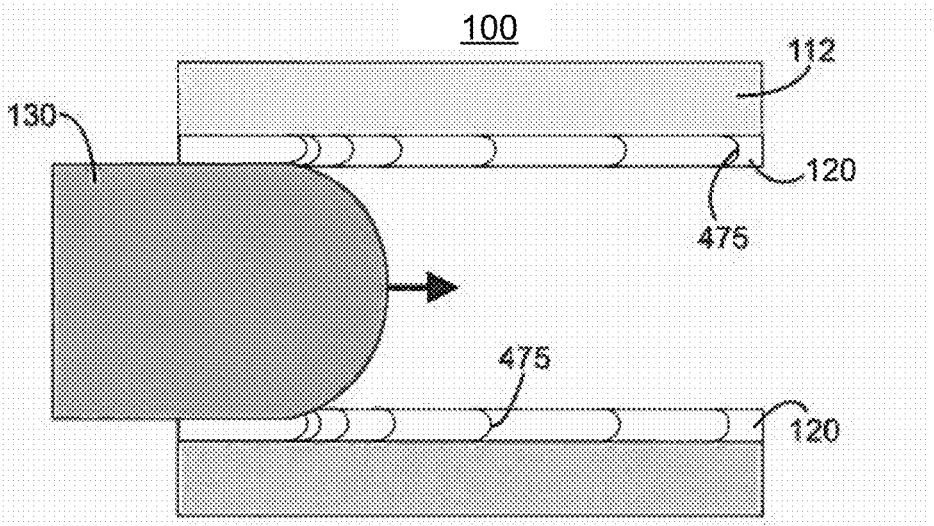
FIG. 4 is an exemplary explanatory illustration of a system for hardening and compacting a cylindrical structure showing failure waves, according to an embodiment of the invention.

Additionally, the impact by the high velocity striker 130 on the glass causes failure waves. FIG. 4 is an exemplary explanatory illustration of a system 100 for hardening and compacting a cylindrical structure, showing failure waves according to an embodiment of the invention. FIG. 4 shows the failure waves 475, which are waves that propagate so the glass material is intact ahead of the wave and comminuted behind the wave. The large amount of kinetic energy stored ahead of the wave must then appear in comminuted form. The failure is explosive, and due to the confined area between the striker 130 and the inner face 115 of the structure, the structure 112 is hardened and compacted.

The impact by the high velocity striker 130 on the glass may involve a third phenomenon which occurs when the high velocity impact of the striker 130 on the glass is so forceful that coesite, stishovite, or seifertite, which are denser forms of silicate, are created. Stishovite has a density of about 4.6 gm/cc as compared to 2.6 gm/cc. It is understood that when the stishovite-type polymorphs rupture they may convert to an amorphous state. It is generally understood that polymorphs that initially form under the high pressure in the glass have smaller volume contents. Then they appear to revert to the larger volume condition, this volume change helping to create the bulking. This rebound effect increases the applied pressure via the volume expansion. It should also be understood that in response to the impact of the high velocity striker, the coesite, stishovite, and seifertite may be created simultaneously, but at different locations. The highest pressures producing stishovite and seifertite, and areas of relatively lower pressures producing coesite.

On average, due to the different phenomenon outlined above, i.e., on account of Reynolds Dilatancy, the formation of failure waves, and the creation of coesite or stishovite, the volume expansion could be up to 40 percent or even greater. Specifically regarding stishovite, expansions of around 77 percent at high pressures may occur. It should be noted that only a limited amount of the material would likely change to this polymorph. Again, as stated above, due to the confined area of the confinement assembly 110, the explosive volume expansion created by the striker assembly 130 impacting the glass, creates intense pressurization forces on the inner face 115 of the structure 112. This results in the hardening and compacting of the inner face 115, with higher and more intense pressures created with the formation of coesite, stishovite, and seifertite, producing a more hardened inner face 115.

Figure 5A:
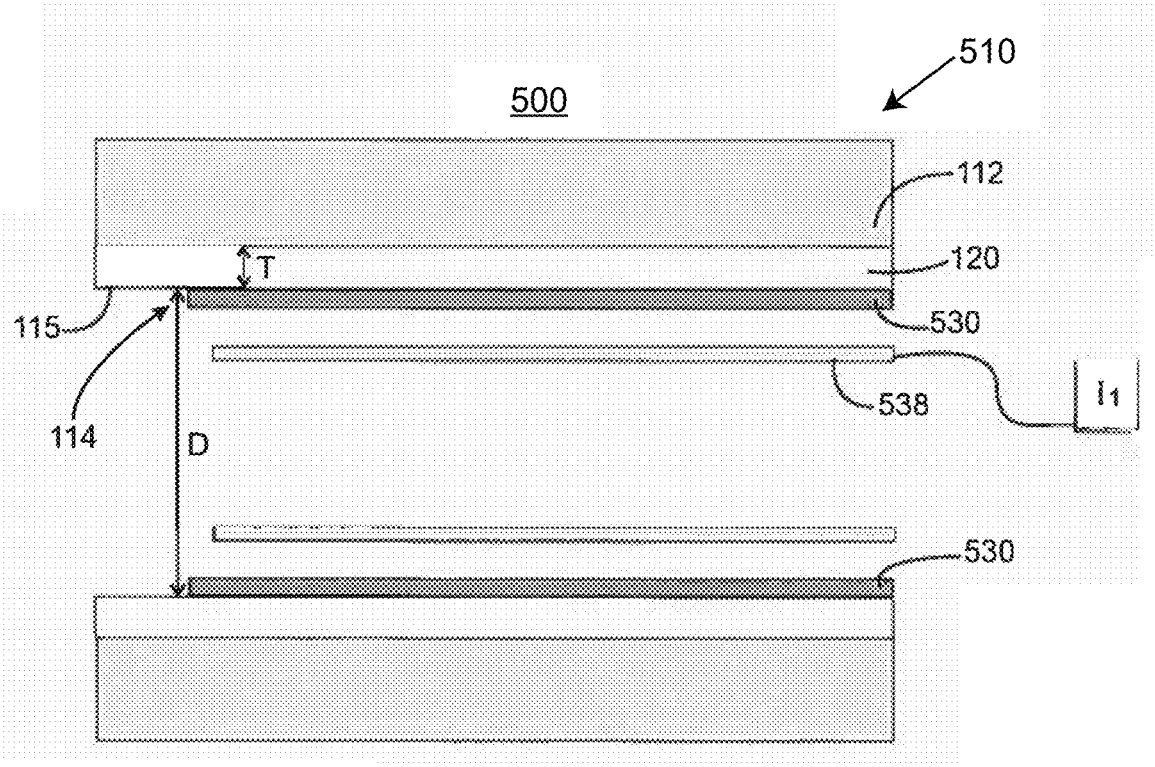
FIG. 5A is an exemplary sectional illustration showing a system for hardening and compacting an inner face of a cylindrical opening of a structure, according to an embodiment of the invention.

FIG. 5A is an exemplary sectional view of a system 500 for hardening and compacting an inner face of a cylindrical opening of a structure, according to an embodiment of the invention. FIG. 5B is an exemplary sectional through BB' of FIG. 5A, showing the system 500 for hardening and compacting an inner face of a cylindrical opening of a structure, according to an embodiment of the invention. As outlined below, the embodiments as illustrated in FIGS. 5A and 5B utilize the electromagnetic expansion of the ring/striker 530.

As shown in FIG. 5A, the system 500 includes a confinement assembly 510 and a striker 530. The confinement assembly 510 includes a structure 112 having an inner cylindrical opening 114 having an inner face 115. As shown in FIG. 5A, the cylindrical opening 114 and the inner face 115 extend in a direction substantially parallel to a longitudinal axis X. The longitudinal axis X extends through the midpoint of the cylindrical opening 114. The striker 530 extends along the entire length of the inner face 115 to be hardened and compacted.

FIG. 5B shows the cylindrical shape of the opening 114 and the inner face 115. The structure 112 may be a working part of a mechanical device and may be a cylinder as shown in FIG. 5B, but may also have any other shape as shown in FIG. 2. The structure 112 may be made from metallic materials such as 1015 steel, 4140 steel, and the like, and may be used as an industrial part. The structure 112 could vary in size, and the cylindrical opening could have a diameter D of about 0.5 inches to about 3.0 inches in diameter.

The confinement assembly 510 also includes a glass tube 120. As outlined above with respect to FIG. 1A, the glass tube 120 is solid and is positioned within and contacting the inner face 115 of the cylindrical opening 114. The glass may be for example, any known type of glass such as silica glass, fused silica, fluoride glass, alumino silicate glass, phosphate glass, borosilicate glass, or flint glass. The glass tube 120 may have a thickness T. According to an embodiment of the invention, the thickness T may be about 0.5 in to about 2.0 in.

FIGS. 5A and 5B show the striker 530, which is an electromagnetically accelerated expanding ring. As outlined below, the striker 530 expands when launching mechanism initiates the expansion. FIGS. 5A and 5B show the striker 530 contacting the glass tube 120. The striker/expanding ring 530 is positioned so that the longitudinal axis X extends through the center of the striker/expanding ring 530, so that the striker 530 is a concentric relationship with the glass tube 120 and the cylindrical opening 114. Alternatively, the expanding ring 530 may be positioned with the tube so that it does not contact the glass tube 120 until it expands when the expansion is initiated by the launching mechanism. Note that in this alternative non-contacting orientation, the longitudinal axis X extends through the center of the ring 530, thereby also providing a concentric arrangement as outlined above.

Figure 5C:
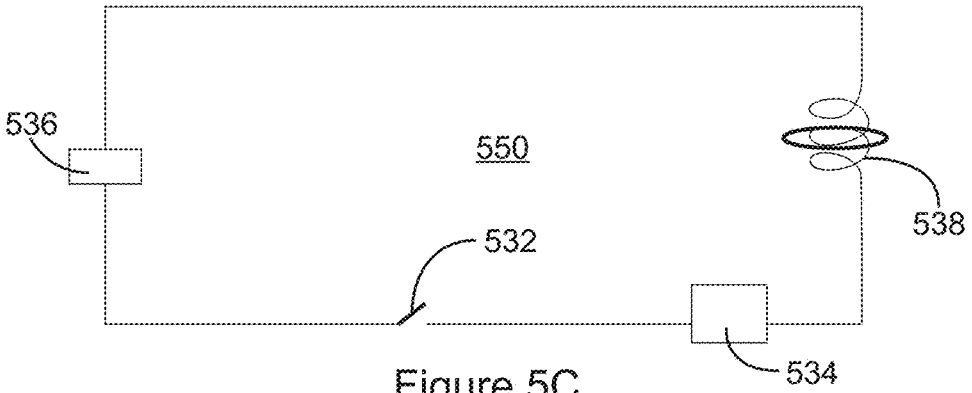
FIG. 5C is an exemplary launching mechanism, according to an embodiment of the invention.
Figure 5B:
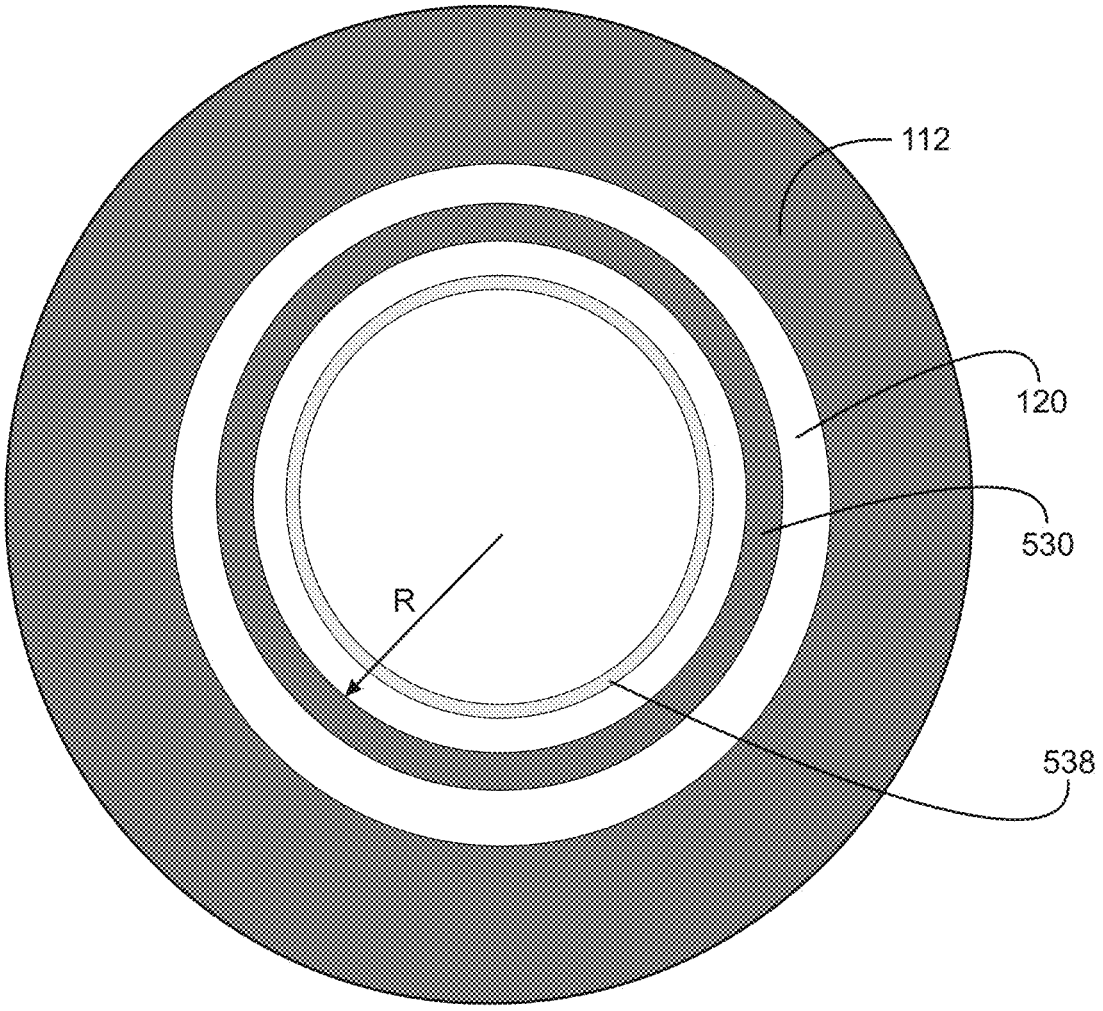
FIG. 5B is an exemplary sectional through BB' of FIG. 5A, showing the system for hardening and compacting an inner face of a cylindrical opening of a structure, according to an embodiment of the invention.

FIG. 5C shows a schematic launching mechanism 550, according to an embodiment of the invention, for launching/expanding the ring 530 so that the ring 530 explosively shatters the glass tube 120. The launching mechanism 550 may be any known electromagnetic circuit that is known to provide this expansion in the striker/ring 530. FIG. 5C shows an electromagnetic circuit 530, having a switch 532, a resister 534, a capacitor system 536, and a wire coil 538. The striker/ring 530 may be a copper ring, and contacts the glass tube 120. The ring is placed concentrically over a mandrel (not shown) containing the wire coil 538.

In operation, when capacitor system 536 is charged to a requisite voltage, and then rapidly discharged through the wire coil/solenoid 538, a magnetic field is produced around the coil. This magnetic field induces an oppositely directed current in the metallic ring 530, which also generates magnetic field. As a result of interaction between magnetic fields originated from coil 538 and ring currents, a uniform radial body force, which accelerates the ring radially to maximal velocity, is created. After the solenoid current drops to low value, the tested ring will continue to expand driven by its inertia. Using known electromagnetic circuits as shown in FIG. 5C, the ring may expand at velocities of about 250 feet per second to about 850 feet per second.

The impact caused by the high velocity striker/ring 530 shatters the glass tube 120 and produces an explosive volume expansion of the glass, which in turn creates a compressive force that acts on the inner face 115 to compact and harden the surface. As outlined above with respect to the system 100, due to the impact of the high velocity striker 530, the glass of the glass tube 120 undergoes volume expansions due to Reynolds Dilatancy and also because of the formation of failure waves. The expansion due the Reynolds Dilatancy and/or the formation of failure waves in the glass creates a pressure against the inner face 115 of the structure 112 that results in the inner face 115 being hardened and compacted.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention. For example, gears, brackets, and bearings may also be treated according to the principles outlined in the instant invention. The invention including the stated variations is intended to be defined by the following claims and their equivalents, in which all terms are meant in their broadest reasonable sense unless otherwise indicated.

What is claimed is:

1. A system for hardening and compacting an inner face of a cylindrical opening of a structure, the system comprising:

a confinement assembly comprising:

a structure having an inner cylindrical opening having an inner face, with a longitudinal axis X extending through the center of the inner cylindrical opening; and a glass tube positioned within and contacting the inner face of the cylindrical opening, the glass tube having a bore, and wherein the longitudinal axis X extends through the center of the glass tube;

a striker for striking and shattering the glass tube; and a launching mechanism for launching the striker to create an explosive volume expansion of the glass, which results in compressive forces being applied to the inner face of the inner cylindrical opening, thereby hardening and compacting the inner face of the structure, wherein the striker is an elongated projectile and wherein the launching mechanism is positioned to launch the striker substantially parallel to the longitudinal axis X, so that the striker is launched into the bore of the glass tube, and wherein the striker has a diameter d and the bore has a diameter B, wherein the diameter d is larger than the diameter B, so that when launched into the bore, the striker shatters the glass of the glass tube to create said explosive volume expansion.

2. The system for surface hardening and compacting of claim 1, wherein the launching mechanism comprises one of, a projectile component or an explosive charge, for launching and directing the striker towards the glass tube, so that upon shattering the glass, one or more of the following occurs;

a. multiple cracks form in the glass tube so that the volume occupied by glass in the glass tube increases as the cracks rupture and expand;

b. failure waves propagate through the glass tube, wherein kinetic energy is stored ahead of the waves;

so that the occurrences of one or more of a and b, creates said explosive volume expansion of the glass, which results in said compressive forces being applied to the cylindrical structure.

3. The system for surface hardening and compacting of claim 2, wherein the launching mechanism comprises one of a projectile component, or an explosive charge for launching and directing the striker into the bore of the glass tube at velocities between 500 feet per second to 20,000 feet per second, so that in addition to the occurrences of one or more of a and b, the following may also occur: c. the glass sleeve develops at least one of coesite, stishovite, or seifertite which rupture and convert to an amorphous state through a volume change to create said explosive volume expansion of the glass.

4. A method of hardening and compacting an inner face of a cylindrical opening of a structure comprising:

providing a confinement assembly comprising:

a structure having an inner cylindrical opening having an inner face, with a longitudinal axis X extending through the center of the inner cylindrical opening; and a glass tube positioned within and contacting the inner face of the cylindrical opening, the glass tube having a bore, and wherein the longitudinal axis X extends through the center of the glass tube;

providing a striker; and providing a launching mechanism for launching the striker;

the method further comprising, launching the striker to create an explosive volume expansion of the glass, which causes compressive forces being applied to the inner face of the inner cylindrical opening, thereby hardening and compacting the inner face of the structure, wherein the launching mechanism comprises one of, a projectile component or an explosive charge, for launching and directing the striker towards the glass tube, so that upon shattering the glass, one or more of the following occurs:

a. multiple cracks form in the glass tube so that the volume occupied by glass in the glass tube increases as the cracks rupture and expand;

b. failure waves propagate through the glass tube with kinetic energy stored ahead of the waves;

so that the occurrences of one or more of a and b, creates said explosive volume expansion of the glass, which results in said compressive forces being applied to the cylindrical structure, wherein the striker is an elongated projectile and wherein the launching mechanism is positioned to launch the striker substantially parallel to the longitudinal axis X, so that the striker is launched into the bore of the glass tube, and wherein the striker has a diameter d and the bore has a diameter B, wherein the diameter d is larger than the diameter B, so that when launched into the bore, the striker shatters the glass of the lass tube to create said explosive volume expansion.

5. The method of hardening and compacting an inner face of a cylindrical opening of a structure of claim 4, wherein the launching mechanism comprises one of a projectile component, or an explosive charge for launching and directing the striker substantially parallel to the longitudinal axis X into the bore of the glass tube at velocities between 500 feet per second to 20,000 feet per second, so that in addition to the occurrences of one or more of a and b, the following may also occur: the glass sleeve develops at least one of coesite, stishovite, or seifertite which rupture and convert to an amorphous state through a volume change to create said explosive volume expansion of the glass.

* * * * *